US006645073B2

(12) United States Patent
Lemay et al.

(10) Patent No.: US 6,645,073 B2
(45) Date of Patent: Nov. 11, 2003

(54) BONUSING APPARATUS AND METHOD FOR GAMING SYSTEM PROVIDING FLEXIBILITY AND INTEREST

(75) Inventors: Steven C. Lemay, Reno, NV (US); Andrea Hughs-Baird, Reno, NV (US)

(73) Assignee: IGT, Reno, NV (US)

( * ) Notice: Subject to any disclaimer, the term of this patent is extended or adjusted under 35 U.S.C. 154(b) by 186 days.

(21) Appl. No.: 09/953,977

(22) Filed: Sep. 17, 2001

(65) Prior Publication Data

US 2002/0010018 A1 Jan. 24, 2002

Related U.S. Application Data

(62) Division of application No. 09/659,954, filed on Sep. 12, 2000.

(60) Provisional application No. 60/153,725, filed on Sep. 13, 1999.

(51) Int. Cl.[7] ..... A63F 9/24; G07F 17/34

(52) U.S. Cl. ..... 463/20; 463/21; 273/138.1; 273/130.2; 273/143 R

(58) Field of Search ..... 463/20, 21, 27, 463/40; 273/143 R, 138.2, 138 A

(56) References Cited

U.S. PATENT DOCUMENTS

| | | | | |
|---|---|---|---|---|
| 4,624,459 A | | 11/1986 | Kaufman | |
| 4,837,728 A | | 6/1989 | Barrie et al. | |
| 5,382,940 A | | 1/1995 | Takemoto et al. | |
| 5,409,235 A | | 4/1995 | Ameri | |
| 5,472,195 A | | 12/1995 | Takemoto et al. | |
| 5,547,192 A | | 8/1996 | Ishibashi | |
| 5,564,700 A | | 10/1996 | Celona | |
| 5,611,730 A | | 3/1997 | Weiss | |
| 5,788,115 A | | 8/1998 | Halliburton | |
| 5,876,284 A | | 3/1999 | Acres et al. | |
| 5,997,400 A | | 12/1999 | Seelig et al. | |
| 6,012,982 A | | 1/2000 | Piechowiak et al. | |
| 6,033,307 A | | 3/2000 | Vancura | |
| 6,059,289 A | * | 5/2000 | Vancura | 273/143 R |
| 6,089,976 A | | 7/2000 | Schneider et al. | |
| 6,102,798 A | | 8/2000 | Bennett | |
| 6,110,043 A | | 8/2000 | Olsen | |
| 6,217,448 B1 | | 4/2001 | Olsen | |
| 6,224,482 B1 | | 5/2001 | Bennett | |
| 6,224,484 B1 | | 5/2001 | Okuda et al. | |

FOREIGN PATENT DOCUMENTS

| | | | |
|---|---|---|---|
| GB | 2 090690 | | 7/1982 |
| GB | 2 147 442 A | | 5/1985 |
| GB | 2 165 385 A | | 4/1986 |
| GB | 2191030 A | * | 5/1987 |
| GB | 2 183 882 A | | 6/1987 |
| GB | 2230373 A | * | 7/1990 |
| GB | 2 242 300 A | | 9/1991 |
| WO | WO 99/19037 | | 4/1999 |

OTHER PUBLICATIONS

New Game Update "Money Time™", International Gaming and Wagering Business, vol. 18, No. 9, 9/97.

* cited by examiner

*Primary Examiner*—Valencia Martin-Wallace
*Assistant Examiner*—Y. Cherubin
(74) *Attorney, Agent, or Firm*—George H. Gerstman; Seyfarth Shaw

(57) ABSTRACT

Gaming terminals or systems with bonus prize or other prize features increasing user interest or entertainment are provided. In one aspect, a plurality of gaming terminals have their displays or other inputs coordinated with one another preferably to provide an impression of linked operation, particularly to provide an impression of increased likelihood of bonus or other prize award. In one embodiment, a bonus prize or feature involves movement among an ordered plurality of positions or stages without needing to forfeit all bonus prizes in the event of a non-bonus-symbol outcome in a main game. In one aspect, a plurality of bonus items are provided with a user being able to select only among a subgroup of the plurality of bonus items at any one time.

11 Claims, 4 Drawing Sheets

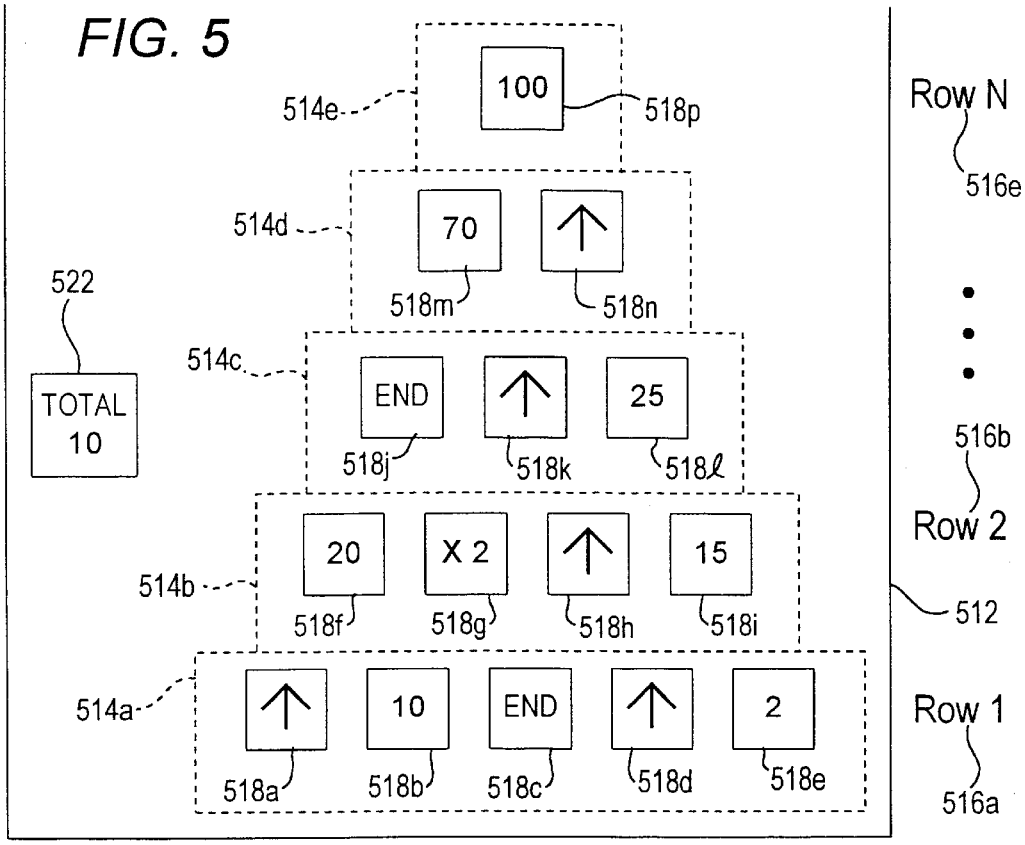
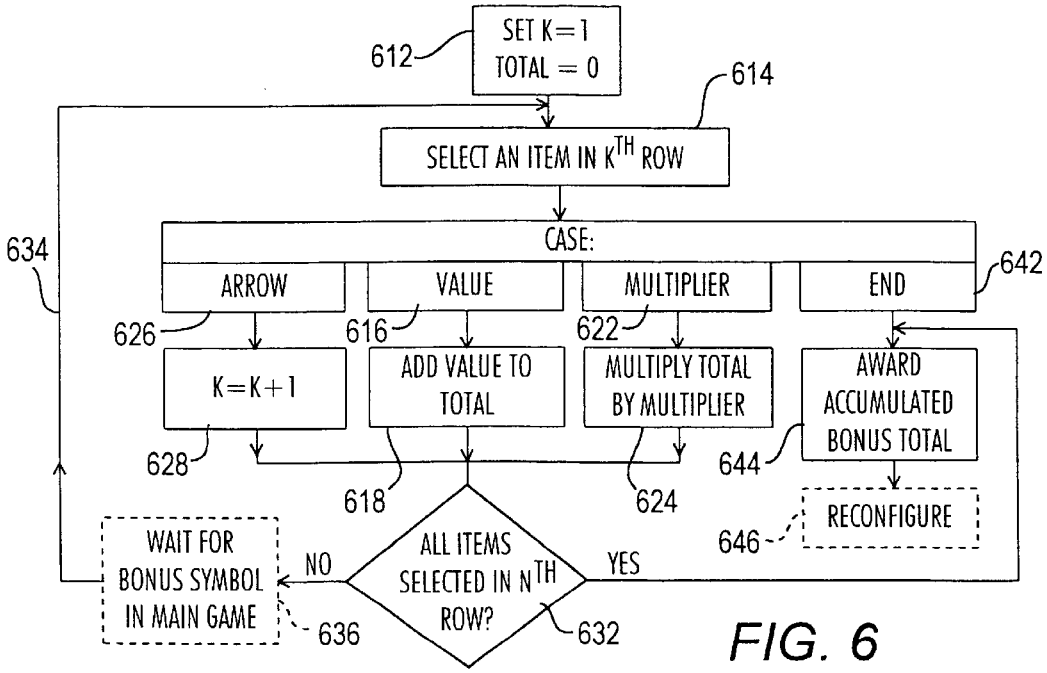
FIG. 6

BONUSING APPARATUS AND METHOD FOR GAMING SYSTEM PROVIDING FLEXIBILITY AND INTEREST

This is a divisional application of U.S. application Ser. No. 09/659,954, filed Sep. 12, 2000.

The present application claims priority in U.S. Provisional Patent Application Serial No. 60/153,725, filed Sep. 13, 1999, incorporated herein by reference.

Cross-reference is made to application Ser. No. 09/395,034, now U.S. Pat. No. 6,346,043 Attorney file No. 14491 entitled "Imaging Matching Game Method", filed on Sep. 13, 1999 and incorporated by reference.

The present invention relates to an electronic gaming terminal apparatus and method and in particular to a gaming terminal which includes a bonus and/or attract system configured to increase the interest and/or entertainment value of the game for users.

BACKGROUND INFORMATION

Players of electronic gaming terminals typically have a wide variety of options available. For example, in a casino setting, there are typically hundreds of different games available to players at various gaming terminals. Casinos and other game operators are advantageously provided with systems which initially attract players quickly to gaming terminal and/or encourage players to continue playing at a gaming terminal. Such features not only are believed to enhance the overall entertainment of players during a trip to the casino (e.g. by maximizing the amount of time spent playing games) but also to enhance casino revenues by decreasing the percentage of time that various terminals may be idle. Accordingly, it would be useful to provide effective systems to assist in attracting and/or retaining players at gaming terminals, preferably in a manner which is relatively inexpensive to design, fabricate, implement and maintain.

Various approaches may be used for attracting players to terminals. In some cases, gaming terminals provide visual (including video) and/or audio or other sound input which attract interest or attention. It is believed that at least some players are attracted by a perception that a gaming terminal, not currently being played, has a relatively high likelihood of providing a prize. Accordingly, it would be useful to provide a system which can both provide an attractive audio or video display and provide an impression or perception of an increased likelihood of winning a prize, but preferably without substantially increasing the cost of operating such terminals or systems.

Some gaming terminals include both a main game (which is the game initially played in response to input of a game wager) and a bonus feature (which is different from the main game). A number of different bonus features are possible, some bonus features providing a monetary or other prize output and some bonus features including an audio or video display or output. Some bonus features are substantially single-event features, i.e., in response to entry of a bonus mode, the player receives a bonus prize and, thereupon, the bonus feature is terminated. It is believed that many single-event bonus features provide less player interest and entertainment than is potentially available and accordingly it would be useful to provide bonusing features which include multiple steps or events before the bonus feature is terminated.

In one game, a bonus is achieved only after progressing sequentially through a series of stages or positions to a final bonus position, with progression continuing only as long as sequential outcomes of the main game include a predefined bonus symbol or outcome (i.e., such that any game outcome lacking the bonus symbol, before the bonus is achieved, resets the bonus system to the initial stage or position in the bonus arrangement). It is believed that such a system may, at least for some players, provide less than optimal interest or entertainment value and accordingly it would be usefull to provide a system in which the award of a bonus prize does not require an unbroken sequential series of main game outcomes containing the bonus symbol or bonus outcome completely until the final and ultimate bonus award stage is reached.

SUMMARY OF THE INVENTION

According to one aspect of the invention, player interest is enhanced by a system which provides an attract or other display which is coordinated among two or more different gaming terminals. For example, an arrangement of a plurality of, preferably commonly-themed, gaming terminals (e.g., racing car theme terminals) can be configured to coordinate displays so as to simulate the display of a racing car moving from terminal to terminal, apparently racing around a ring of terminals, or the like. Preferably, the attract display is also coordinated with a prize to be provided by one of the terminals in the group, e.g., providing a perception that the attract display is indicative of an enhanced probability of the prize award among the group of terminals participating in the display.

In one aspect, the bonus feature involves progressing through a sequential plurality of stages or positions on a display with at least an ultimate position being associated with a (preferably relatively large) bonus prize. In one embodiment, additional prizes amounts are associated with one or more intermediate positions. In one embodiment, any accumulated bonus amounts are awarded at the termination of the bonus feature regardless of whether the ultimate stage or position has been reached. In one embodiment, the bonus feature is terminated by the occurrence of a specific termination or "bust" symbol, e.g., in the main game or in the bonus feature. In one embodiment, the lack of the appearance of a bonus symbol in the main game does not result in termination or re-setting of the bonus feature.

In one aspect, the bonus feature defines a plurality of selectable items or positions which are collected in two or more groups (such as two or more rows or other arrangements of selectable items) such that selection of an item associated with a "next group" or "next row" symbol must be selected for the player to be able to select among items in a different group. In one embodiment, at the termination of a bonus feature, the items or stages in the bonus feature are repositioned or reconfigured so that the arrangement of each bonus feature is different from previous bonus features.

In one aspect gaming terminals or systems with bonus prize or other prize features increasing user interest or entertainment are provided. In one aspect, a plurality of gaming terminals have their displays or other inputs coordinated with one another preferably to provide an impression of linked operation, particularly to provide an impression of increased likelihood of bonus or other prize award. In one embodiment, a bonus prize or feature involves movement among an ordered plurality of positions or stages without needing to forfeit all bonus prizes in the event of a non-bonus-symbol outcome in a main game. In one aspect, a plurality of bonus items are provided with a user being able to select only among a subgroup of the plurality of bonus items at any one time.

BRIEF DESCRIPTION OF THE DRAWINGS

FIG. 5 is a front elevational view of a display showing aspects of a bonus feature according to an embodiment of the present invention; and FIG. 6 is a flow chart depicting steps in a bonus feature of the game according to one embodiment of the present invention.

DETAILED DESCRIPTION OF THE PREFERRED EMBODIMENT

Figure 1:
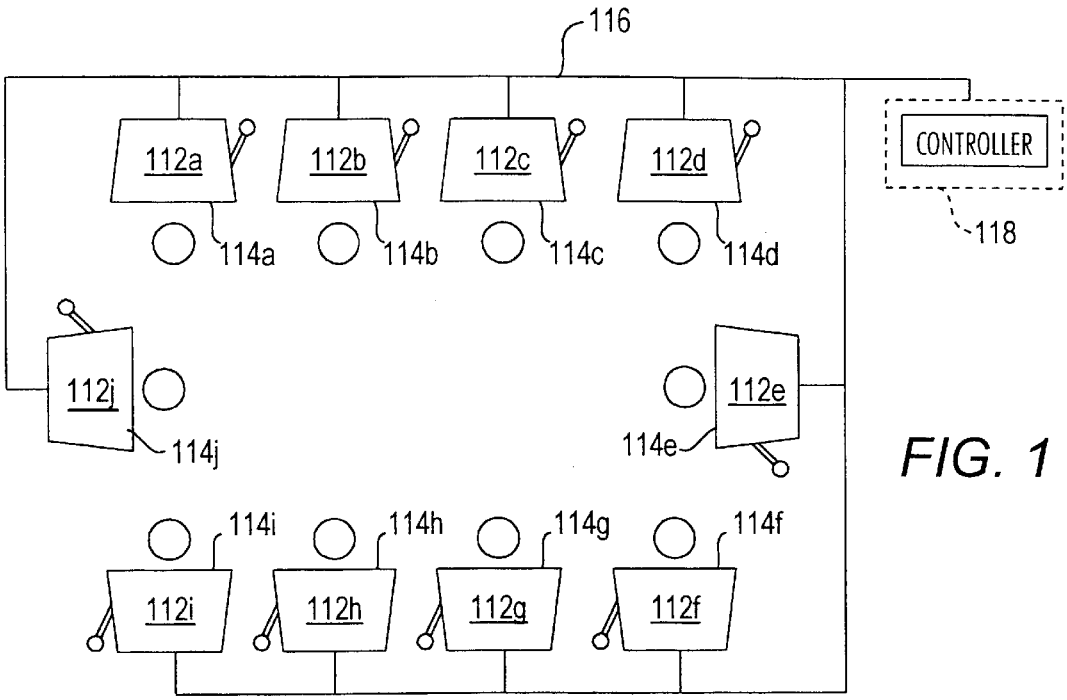
FIG. 1 is a block diagram, indicative of a top plan view of a group of gaming terminals useable in accordance with an embodiment of the present invention.

According to one embodiment, an attract display is coordinated among a plurality of different gaming terminals. Preferably, the attract display is coordinated among gaming terminals which are positioned in a known or predetermined arrangement, preferably substantially near or adjacent one another. In the embodiment of FIG. 1, ten gaming terminals 112*a*–112*j* are arranged in an elongated rectangular fashion with the screens facing inward. Numerous other arrangements can be used such as arrangements with the screens facing outward, unshaped arrangements, circular or oval arrangements, polygon-shaped arrangements and the like. Preferably the attract display shown in the various screens 114*a–j* of the terminals 112*a–j* are spatially and/or temporally coordinated, e.g., to, at selected times, provide viewers with the impression that the gaming terminals 112*a–j* are linked to one another. In one embodiment, an image (which may, if desired, be an image related to a common theme or feature of the gaming terminals 112*a–j*) is displayed sequentially on one screen after another in the group, e.g., to give the general impression of the image moving sequentially from one terminal to the other 112*a* through 112*j*. For example, the system can be configured to display the image of a race car on the screen 114*a* of the first terminal 112*a* initially (preferably in such fashion as to appear to move towards the second terminal 112*b*) and then to be removed from the screen of the first terminal 112*a* and appear on the screen 114*b* of the second terminal 112*b* (preferably in a fashion appearing to move towards third terminal 112*c*). By repeating this process sequentially for the various terminals 112*a* through 112*j*, the attract display can be configured to have the appearance of the race car or other image moving, in order, around the terminals 112*a*–112*j* in the group. As another example, some or all of the displays in the group can be controlled to flash or provide a predetermined display simultaneously. Simultaneous displays and/or patterns of displays can be provided on all gaming terminals of a group or on only some terminals. For example the system can be configured such that a first predetermined portion (e.g. half) of the gaming terminals a output a first display and the remaining terminals (simultaneously with the first display or sequentially) output a second, different display. Such attract displays, especially when provided with appropriate accompanying audio output, is believed to not only attract attention and excitement regarding the group of terminals 112*a*–112*j*, but to also leave the impression that the terminals 112*a*–112*j* are electronically linked together.

Preferably, the attract display is coordinated with an award of a bonus or other prize, e.g., in a fashion to provide potential players with the impression or perception that, following the attract display, the terminals in the group 112*a*–112*j* have an enhanced probability of being terminals which will output a bonus or other prize. For example, in one embodiment the attract display is not initiated until it is known that at least one of the terminals 112*a*–112*j* in the group is about to output a bonus or other prize. Preferably, the attract display will end with a particularly impressive portion of the attract display conducted at the terminal which will output the bonus or other prize, thus potentially giving the impression that the attract display was the cause or the precursor for the award of the bonus at one of the terminals 112*a*–112*j* of the group. However, since the prize which is awarded will be a prize that has already been determined for awarding (based on normal play of a game at one of the terminals), there is no additional prize cost or other operating cost (i.e., no cost in addition to the normal prize or operating costs associated with normal play of any individual terminal in the group). In this way, it is possible to provide potential players with an impression that the terminals in the group 112*a–j* may have an enhanced probability of outputting a bonus or other prize (and thus attracting players to use the gaming terminals in the group) but without having to incur additional expenses associated with providing additional prizes (i.e., prizes other than would be normally awarded from normal play on any individual terminals in the group). Furthermore, it is possible to provide a variety of gaming terminals that are configured to provide such coordinated display near one another and to achieve the coordinated display without regard to the theme and/or configuration of the individual gaming terminals that make up the group.

In one embodiment, the attract display is configured to be initiated in a fashion such that it may not be readily apparent that the prize which occurs at the end of the display had already been won or earned as a result of ordinary play of the game. This can be achieved in a number of fashions. In one fashion, the gaming terminal may be configured with one or more bonus prizes or awards which are awarded in consequence of a gaming outcome which is not displayed to the player. For example, in the context of a slot machine gaming terminal, which may have a plurality of symbols of any one kind on the slot machine reels (e.g., may have a plurality of, for example, lemon symbols), the terminal can be configured such that one particular lemon symbol is designated, in the pay table, as associated with a bonus or other prize but in such a fashion that such lemon symbol, as displayed to the user, is indistinguishable from other lemon symbols. In this way, a player may win a bonus prize during normal play of the game when the designated "special" lemon symbol appears on a payline but the player would normally not perceive this result as being any different from a result with a different (nonspecial) lemon symbol appearing on the payline (and which would not result in a bonus prize award). If desired some or all gaming terminals in a group can be provided with multiple "special" outcome symbols (i.e. symbols which initiate or affect the bonus game and/or coordinated display). If desired different ones of the special symbols can be associated with different bonuses and/or different coordinated displays.

In another fashion, the gaming terminal may be provided with a plurality of different bonus or other prizes but with only some instances of a bonus prize (preferably randomly selected instances) acting to trigger an attract display as described herein.

In another fashion, the attract display is configured such that the terminal on which the attract display is initiated can be different from the terminal which eventually receives a bonus or other award, potentially giving the appearance that there is no causal connection between the winning of a bonus or other prize and the initiation of an attract display.

Accordingly, when a system is configured using some or all of the above-described techniques, it will appear, to players and potential players, that the group of terminals 112*a*–112*j* provide a linked or coordinated display at random times, beginning and ending at random terminals in the group, and with the ending terminal receiving the award of a prize, apparently unrelated to events of normal game playing at the terminal. However, this type of attract display, although believed particularly effective in achieving the interest and participation of potential players, can be configured to occur substantially without additional prize costs.

In order to coordinate the display as described above, the terminal 112*a*–112*j* are coupled via a communication link 116. In the embodiment depicted in FIG. 1, the terminals in the group 112*a*–112*j* are coupled to a separate controller device 118 which can be a computer, communicating with the terminals, e.g. via a local area network (LAN) or other link. Although FIG. 1 depicts a backbone communication architecture, other architectures can be used including a daisy chain architecture, a hub and spoke architecture and the like. It is possible to configure a system in which, rather than providing coordination using a separate controller device 118, one or more of the terminals 112*a*–*j* may perform the control functions. For example, in one configuration, in order to initiate the display, one of the terminals (which may be the terminal in which a payment or prize is to be awarded) will send a communication to the remaining terminals in the group indicating that the first terminal will act as a master terminal, whereupon the remaining terminals in the group will operate in a slave fashion with regard to the display. Preferably, such a system is configured such that, if the master terminal becomes disconnected or otherwise cannot properly operate as the master terminal, another terminal (e.g., with a next-lower or next-higher identification number within the group, or the like) will automatically assume the master controller role. It is also possible for the winning machine to temporarily become the master controller to coordinate display, and thus providing a "floating" master controller.

Figure 2:
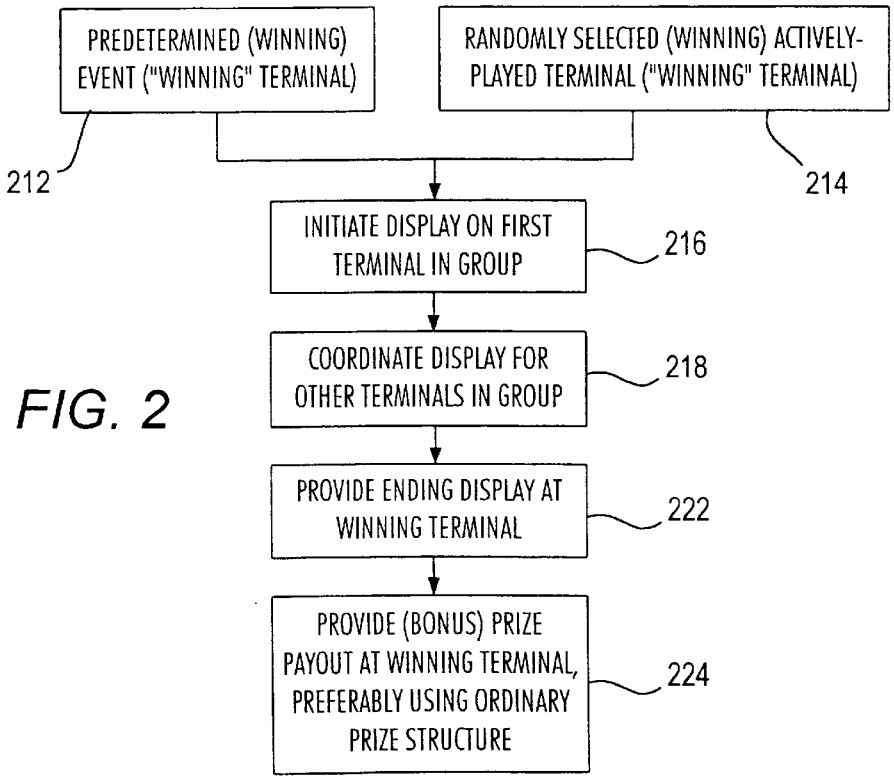
FIG. 2 is a flow chart depicting a process useable in connection with a group of gaming terminals including as illustrated in FIG. 1, according to an embodiment of the present invention.

As depicted in FIG. 2, according to one embodiment, the procedure for providing an attract display can begin either in response to a predetermined winning event 212 at a terminal (defining the terminal as the "winning" terminal) and/or at a randomly selected (preferably winning) terminal which is actively being played 214 (defining a "winning" terminal). When the controller detects or declares such an initiating or triggering event 212, 214, the controller 118 selects a first terminal within the group 112*a*–112*j* to be the terminal which will initiate the attract display 216. Preferably, the attract display is initiated on a terminal other than the terminal where a prize will be awarded, i.e., other than the "winning" terminal. In one embodiment, the initiating terminal is spaced a predetermined (or randomly selected) number of terminals (in a predetermined or randomly selected direction) from the winning terminal. In another embodiment, the attract display initiating terminal is randomly selected among (preferably non-winning) terminals. The controller 118 then sends signals appropriately to the various terminals 112*a*–112*j* instructing terminals, preferably sequentially, provide the attract display on the respective display screens 114*a*–114*j*. This procedure is repeated preferably for a predetermined time period, e.g., sufficient to attract the attention of prospective players. At the end of the attract display period, the controller 118 sends a signal to the winning terminal to provide an ending display 222. Preferably, the ending display is particularly interesting such as having additional and/or specially animated graphics or other display, amplified or otherwise distinctive audio output and preferably drawing attention to the fact that the terminal will be awarding a prize. Preferably, the winning terminal then provides the bonus or other prize and the process of the attract display terminates 224.

Figure 3:
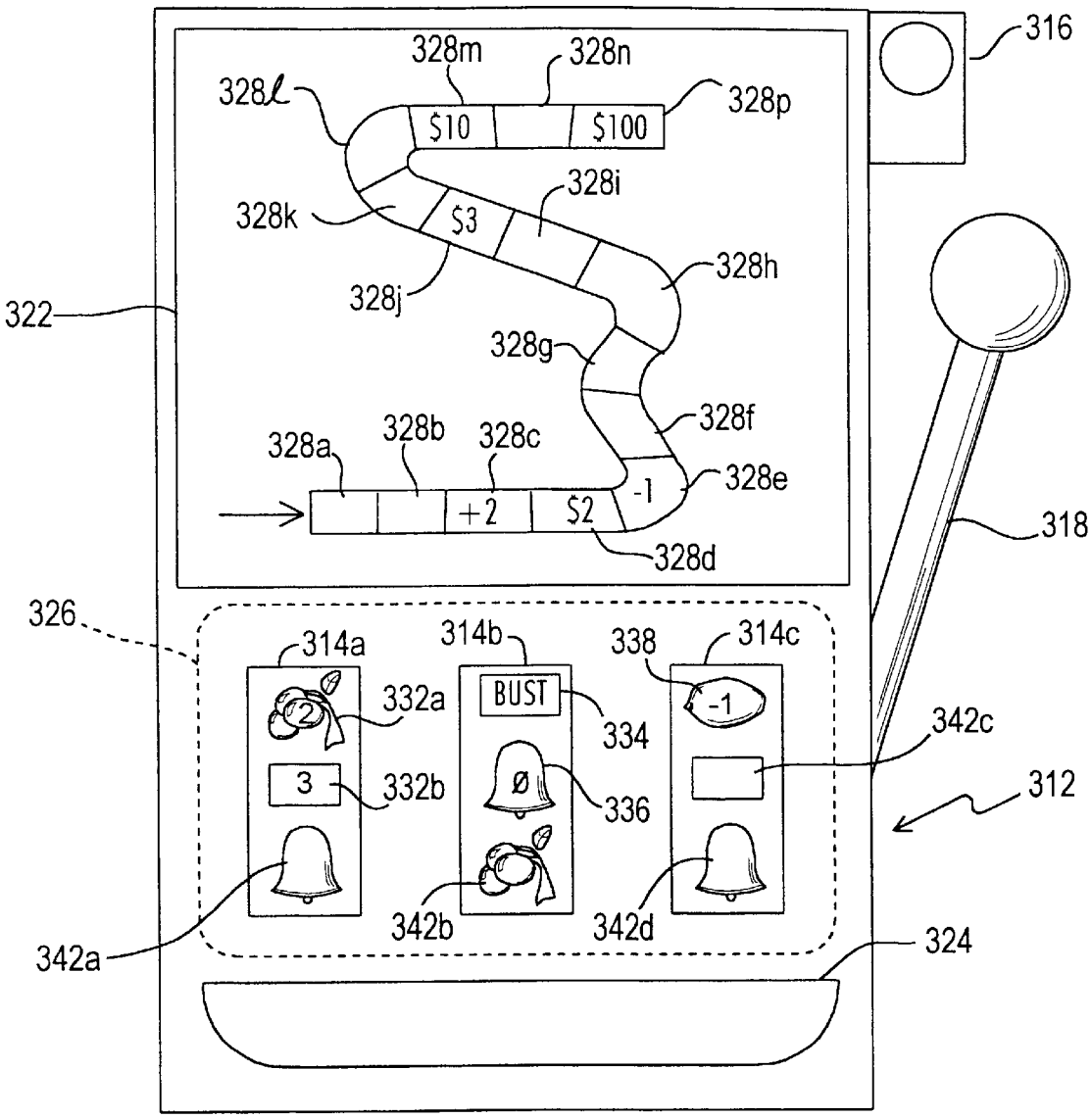
FIG. 3 is a front elevational view of a gaming terminal including a bonus display according to an embodiment of the present invention.

Although the above-described attract display aspect can be used in connection with a plurality of different bonus prizes or other prizes, it is believed particularly advantageous to use gaming terminals which can provide certain non-static or multiple-event bonus features. FIG. 3 depicts a gaming terminal of the slot machine type 312 having a plurality of mechanical or simulated reel displays 314*abc*, a coin or other wager input device 316, a pull handle 318 or other gaming control, a bonus display 322 which can be, e.g., a computer controlled CRT or LCD display, a back-lit display, a mechanical display and the like and a coin tray or other prize output device 324. In the depicted gaming terminal 312, the main game (i.e., the game which is played normally in response to input of a wager by the wagering device 316) is the slot machine game 326. Preferably, the bonus feature is available only after playing one or more rounds of the main game 326, such as in response to one or more particular outputs or gaming outcomes of the main game 326. Although, for purposes of illustration, the embodiment of FIG. 3 shows potential bonus values appearing on any of the slot machine reels 314*abc*, it is also possible to provide bonus values on only one of the reels (e.g., to avoid ambiguity that could arise from the appearance of two or more contradictory bonus values along the pay line).

In the depicted embodiment, the bonus feature involves a plurality of sequential or ordered steps or positions on the display 322, beginning at a first position 328*a* with subsequent ordered stages or positions 328*b* through 328*n* leading to a final stage or position 328*p*. In the depicted embodiment, the final position 328*p* is associated with a, preferably largest, bonus prize. In the depicted embodiment, some or all of the intermediate stages or positions 328*a*–328*n* are associated with intermediate prizes 328*d*, 328*j*, 328*m*, advancement values 328*c* or retreat values 328*e*. In the embodiment depicted in FIG. 3, the main game 326 has a plurality of potential game output symbols, at least some of which are associated with bonus advancement values 332*a* 332*b* termination or bust values 334, zero or neutral values 336, negative or retreat values 338 and, some of which 342*a* through 342*d* may have no bonus value associated therewith.

Figure 4:
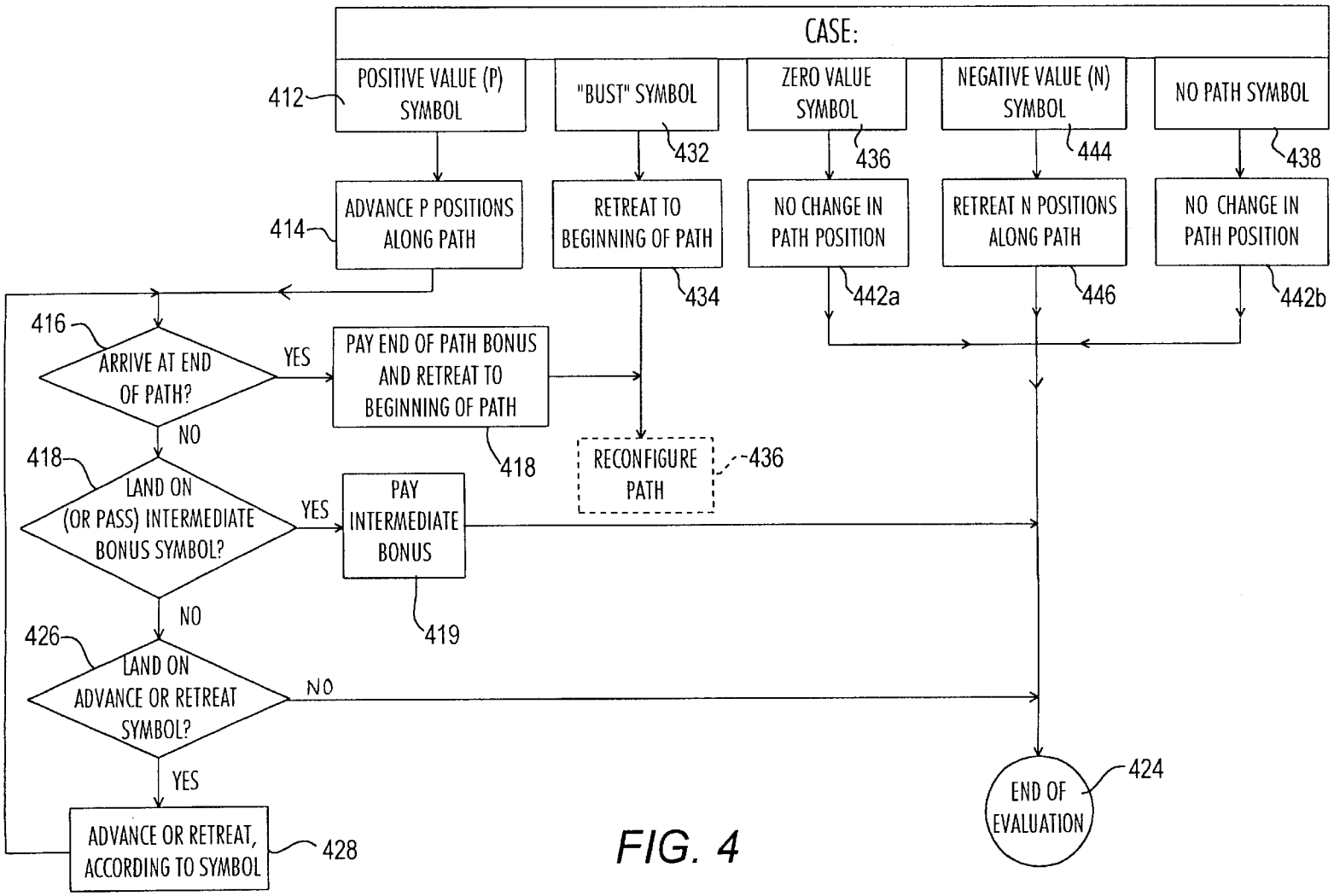
FIG. 4 is a flow chart of a process that can be used in accordance with a bonus feature according to an embodiment of the present invention.

As depicted in FIG. 4, evaluation of an output of the main game 326 for effect on the bonus feature depends on the appearance of bonus values or symbols in the main game 326. In the embodiment of FIG. 4, when the main game provides a positive value symbol on a pay line 412 (such as having value P), a current position marker on the bonus display 322 (which may be a symbol displayed on the display screen 322, differential illumination of the stages or positions or the like) is advanced P positions along the sequential path from 328*a* towards 328*p*. Thus, at the initiation or beginning phase, the marker is positioned at or before the first stage or position 328*a*. If, for example, the value of P were 3 (332*b*) the marker would be advanced three positions, e.g., to position 328*d*. At the end of the advancement, the bonus display is evaluated 416 to determine whether the marker has arrived at the end of the path, i.e., the last stage or position 328*p* and, if so, the end-of-path bonus (e.g., $ 100 in the embodiment depicted in FIG. 3) is paid 418, and the marker retreats to the beginning of the path, i.e., at or before position 328*a*. If not at the end of the path, the system determines 418 whether the marker has landed on (or, in some embodiments, passed through) an intermediate bonus symbol (328*d*, 328*j*, 328*m*) in which case the intermediate bonus is paid 419, thus ending the evaluation procedure 424. If the marker did not land on an intermediate bonus symbol, it is determined whether the marker landed on an advance symbol (328*c*) or a retreat symbol (328*e*) 426, in which case the marker is advanced or retreated according to the symbol 428 and the new position is evaluated 416, 418. Otherwise, the evaluation procedure ends 424. If the main game 326 results in a "bust" or termination symbol 334 along a pay line 432, the marker retreats to the beginning of the path 434. In one embodiment, when the marker retreats the beginning of the path, either as a result of the bust symbol 434 or because of arrival of the end of the path 418, the path is preferably reconfigured 436, e.g., to change the values or positions of the positive, negative, zero or bust symbols along the path, the number of stages and the like.

As depicted in FIG. 4, if the main game results in a zero value symbol 336 or results in no bonus path symbol 342*a–d*, 338, there is no change in the path position (i.e., no change in the position of the marker 342*a* 342*b*) and the evaluation phase ends 424. If the main game provides 338 a negative value symbol 444 the marker will retreat N positions along the path 446 (i.e. toward the starting position) before the end of the evaluation 424.

FIG. 5 depicts a display 512 in which bonus feature regions or spaces are organized into groups 514*a–e* (in the depicted embodiment, displayed as rows 516*a*–516*e*). Although a number of ways of organizing and/or displaying the groups of spaces or symbols can be used, in the depicted embodiment, the groups are organized in order of decreasing size, forming a triangle or pyramid shape. The various spaces or symbols 518*a*–518*p* are associated with one or more values (518*b, e, f, i, l, m, p*) multipliers (518*g*) "next row" symbol (518*a*, 518*d*, 518*h*, 518*k*, 518*n*) or end or "bust" symbols (518*c*, 518*j*). Preferably, the symbols associated with the various spaces are initially concealed from the player and are only revealed after a player selects a space or area (e.g., via a key or keyboard, touch screen or similar selection procedure or device). Preferably, a player can only select from the symbols or spaces in a single group or row 514*a–e* at any time. In one embodiment, the bonus feature is initiated in response to the appearance of a predefined bonus symbol or game output in the main game. As depicted in FIG. 6, the bonus feature is initiated by setting the current row counter (K) to the lowest value (L), and setting the total or accumulated bonus (which is preferably displayed 522) to zero 612. The user is then permitted to select one of the items in the first row 614. If the item selected by the player is associated with a bonus value 616, that value is added to the total 618. If the item selected is a multiplier 622, the amount in the total 522 is multiplied by the multiplier 624. If the item selected is an arrow or "next row" symbol 626, the row counter K incremented 628. If, following the selection of the item, it is determined that all items in the end or last row have been selected 632, the bonus round is terminated. Otherwise, the system loops 634 to permit selection of the next item, possibly after waiting for the appearance of another bonus symbol in the main game 636 (e.g., if it is desired to implement the bonus as a persistence feature). If the item selected is an end or bust symbol 642, the system, in the depicted embodiment, awards the accumulated bonus total 522 to the player 644. Preferably, after an end or bust feature (either because of the selection of an end symbol or because all items in the nth row have been selected) the bonus screen or feature is reconfigured 646, e.g., by changing the position, magnitude, nature and/or number of items in the bonus display.

In light of the above-description a number of advantages of the present invention can be seen. The present invention can attract potential players to a gaming terminal among a group of gaming terminals, preferably providing a perception of an increased likelihood of award of a bonus or other prize among the group of gaming terminals, but without the need for increasing the prize or operating costs in the group of terminals. The present invention can provide a bonus feature which includes a sequential series of stages or positions leading to a ultimate bonus without requiring forfeiture of all bonus amounts in the bonus round should the player fail to reach the ultimate bonus position before receiving a non-bonus-symbol result in the main game. In general, the present invention can provide for increased attractiveness and/or entertainment value associated with bonus prizes or other prizes in a gaming system preferably at relatively low cost of design, fabrication, operation and/or maintenance.

A number of variations and modifications of the present invention can be used. It is possible to use some features of the invention without using others. For example, it is possible to use the described attract feature without using the bonus features of FIGS. 3–6 and vice versa. Although the invention has been illustrated by way of procedures including procedures of FIGS. 2, 4, and 6, some or all aspects of the invention can be provided in other fashions including by implementing procedures having more or fewer steps and/or steps performed in a different order than that depicted. Although in the embodiment of FIG. 3, the symbols or values on the path are displayed, it is also possible to provide a configuration in which some or all symbols are hidden unless and until the marker lands on such symbols or spaces. Although the embodiment of FIG. 3 depicts a single linear path. it is also possible to provide configurations in which there may be a forked or branched path with symbols selecting or toggling the choice between left and right branches and the like. In one embodiment, in the configuration of FIG. 3, intermediate bonus values are paid (or vested) when the marker lands on (or passes) intermediate bonus values. In other embodiments, intermediate values are not paid or vested unless the marker reaches the end of the path, or reaches a pay symbol or similar symbol (not shown). Thus, in some embodiments, upon landing on a "bust" symbol, players will still receive intermediate bonus values while in other embodiments, landing on a "bust" symbol results in forfeiture of intermediate bonus values. In the embodiment depicted in FIGS. 3 and 4, the bonus feature has a persistence aspect whereby movement along the bonus path is interspersed with rounds of the main game so that two or more rounds of the main game may be played between the time that the bonus feature is initiated and the time that it is terminated (e.g., as a result of a bust or reaching the end of the path). However, it is also possible to configure the embodiment of FIGS. 3 and 4 in a non-persistence fashion such that once the main game provides a output resulting in initiation of the bonus feature, the bonus feature will continue, without further play of the main game, until the bonus feature is terminated, whereupon the play of the main game can resume, if desired. Similarly, although the embodiment depicted in FIGS. 5 and 6 provides a substantially non-persistent game wherein, once the bonus feature is initiated, the bonus feature continues until termination (either from a bust symbol or from reaching the last symbol in the last row) before play of the main game is resumed, it is also possible to configure an embodiment generally in accord with FIGS. 5 and 6 but in which rounds of the main game are interspersed with the bonus feature (without the need to terminate the bonus feature through a "bust" symbol or reaching the last symbol in the last row) before resuming main game play. Coordinated display can be provided using any of a number of different displays, including a display used for playing a primary game (e.g. the main video display of a video gaming device), a bonus display device, and/or a separate display used only for coordinated and/or attract display. Using a display device which is also used for other gaming operations can reduce cost and or hardware requirements for implementing embodiments of the present invention. Co-ordination among several gaming terminals can include co-ordination of items in addition to (or in place of) coordination of video screen displays, including, e.g. co-ordination of lights, co-ordination of bells or other audio items, and the like. A coordinated display can be provided in connection with any of a plurality of different types of games, including slot machine games, electronic poker or other card games, keno games, or groups of terminals which play a variety of different games (in the same co-ordinated display group).

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A gaming method comprising:

providing an electronic gaming terminal with main reels for giving a player an opportunity to play a round of a main game in response to at least a first wager amount;

providing a bonus game, different from said main game;

displaying, on a bonus display device, a path including a plurality of bonus game positions, said bonus game positions including a start position, intermediate positions and an end position;

operating the main reels of said main game to control said bonus game positions, including the steps of changing said bonus game positions in accordance with indicia on said main game reels, and terminating said bonus game in accordance with indicia on said main reels; and paying an amount responsive to a final bonus game position resulting from operation of said main game reels.

2. A gaming method as defined in claim 1, including the step of reconfiguring said first path after said amount is paid.

3. A gaming method as defined in claim 2, in which said reconfiguring step comprises changing prize values.

4. A gaming method as defined in claim 2, in which said reconfiguring step comprises changing the number of bonus game positions.

5. A gaming method as defined in claim 1, including the step of incrementing a bonus prize counter by a prize amount associated with a new bonus game position toward said end position.

6. A gaming method as defined in claim 1, including the step of providing a bust indicator on said main game reels, and terminating said bonus game when said main game reels stop at said bust indicator.

7. A gaming method comprising:

providing an electronic gaming terminal with main reels for giving a player an opportunity to play a round of a main game in response to at least a first wager amount;

providing a bonus game, different from said main game;

displaying, on a bonus display device, a first path including a plurality of bonus game positions, said bonus game positions including a start position, intermediate positions, and an end position;

controlling said bonus game positions, including the steps of changing said bonus game positions and terminating said bonus game in response to an outcome with respect to said bonus path positions;

creating a second path including a plurality of bonus path positions in response to an outcome with respect to bonus path positions of said first path; and paying an amount responsive to a final bonus game position.

8. A gaming method as defined in claim 7, comprising the step of reconfiguring said first path after said amount is paid.

9. A gaming method as defined in claim 7, in which said reconfiguring step comprises changing prize values.

10. A gaming method as defined in claim 7, in which said reconfiguring step comprises changing the number of positions.

11. A gaming method as defined in claim 7, including the step of incrementing a bonus prize counter by a prize amount associated with a new bonus game position toward said end position.

* * * * *